United States Patent [19]

Schlottke

[11] Patent Number: 4,964,626

[45] Date of Patent: Oct. 23, 1990

[54] APPARATUS FOR STACKING PAPER WEBS IN ZIG-ZAG FORMATIONS

[75] Inventor: Karl-Heinz Schlottke, Tangstedt, Fed. Rep. of Germany

[73] Assignee: E.C.H. Will GmbH, Hamburg, Fed. Rep. of Germany

[21] Appl. No.: 309,426

[22] Filed: Feb. 10, 1989

[30] Foreign Application Priority Data

Feb. 12, 1988 [DE] Fed. Rep. of Germany ..... 3804366

[51] Int. Cl.[5] ..... B41L 1/32

[52] U.S. Cl. ..... 270/39; 270/32; 493/410

[58] Field of Search ..... 270/4, 20.1, 21.1, 30, 270/31, 32, 39, 40, 41, 52, 52.5; 493/410, 413–415, 451

[56] References Cited

U.S. PATENT DOCUMENTS

| | | | |
|---|---|---|---|
| 4,201,102 | 5/1980 | Rudszinat | 83/298 |
| 4,255,998 | 3/1981 | Rudszinat | 83/298 |
| 4,683,704 | 8/1987 | Vorachek | 53/461 |
| 4,708,332 | 11/1987 | Basemann | 270/39 |

FOREIGN PATENT DOCUMENTS

| | | | |
|---|---|---|---|
| 2101100 | 1/1983 | United Kingdom | 270/30 |

*Primary Examiner*—Edward K. Look

*Assistant Examiner*—Therese M. Newholm

*Attorney, Agent, or Firm*—Peter K. Kontler

[57] ABSTRACT

A running web of computer paper is provided with transversely extending rows of perforations between successive coherent panels which are thereupon folded over each other in zig-zag formations to be converted into a series of stacks. When a stack exhibits a tendency to lean forwardly or backwards, as considered in the direction of advancement of the web, the web is stretched in the regions which are to be provided with perforations and the web is thereupon permitted to contract so that certain panels are slightly shorter than the remaining panels. This eliminates the tendency of the stacks to lean forwardly or backwards. In order to eliminate the tendency of stacks to lean in one direction, the web is stretched for the making of successive or selected oddly numbered rows of perforations, and the tendency of stacks to lean in the other direction is eliminated by stretching the web during the making of successive or selected evenly numbered rows of perforations. Signals which initiate stretching of the web (either by accelerating the web downstream of the perforating station and/or by altering the length of the path for the web upstream of the perforating station) can be generated by hand as a result of visual observation of growing stacks, or automatically in response to signals from one or more inclination monitoring devices.

28 Claims, 3 Drawing Sheets

APPARATUS FOR STACKING PAPER WEBS IN ZIG-ZAG FORMATIONS

BACKGROUND OF THE INVENTION

The invention relates to a method of and to an apparatus for converting webs of paper or the like into a series of stacks with coherent sheets or panels in zig-zag formations. More particularly, the invention relates to improvements in methods of and in apparatus for converting a continuous web of paper or the like into a succession of coherent panels which are bounded by transversely extending weakened portions of the web, and for thereupon transforming such succession of coherent panels into a series of discrete stacks of superimposed panels in zig-zag formations.

The manner in which a web of paper or the like can be converted into a succession of coherent panels with transversely extending weakened portions (such as rows of perforations) between neighboring panels is fully disclosed in commonly owned U.S. Pat. No. 4,708,332 granted November 24, 1987 to Besemann for "Method and apparatus for zig-zag folding webs of paper or the like". Commonly owned copending patent application Ser. No. 268,472 filed Nov. 7, 1988 by Peter et al. discloses a method of and an apparatus for subdividing a continuous web into a series of shorter webs and for spacing apart successive shorter webs for the purpose of facilitating conversion of successive shorter webs into discrete stacks of overlapping panels in zig-zag formations.

A drawback of presently known apparatus for gathering stacks of superimposed panels in zig-zag formations is that the stacks tend to lean forwardly or backwards (as considered in the direction of transport of a continuous web and of shorter webs through the apparatus). In other words, certain stacks fail to assume a predetermined shape which is best suited for introduction into boxes or like receptacles. Departure of the shape of certain stacks from a truly parallelepiped shape creates problems during boxing or crating of forwardly or rearwardly leaning stacks. Typical examples of stacks which are obtained by zig-zag folding predetermined numbers of panels consisting of paper or the like and being connected to each other by transversely extending weakened portions (which normally contain rows of perforations) are stacks of so-called computer paper which is provided with marginal and other perforations for convenience of manipulation in a computer and/or upon removal from the computer. Failure of a single stack of a long series of stacks to enter a box or a like receptacle is likely to necessitate a shutdown of the entire production line with attendant huge losses in output.

OBJECTS OF THE INVENTION

An object of the invention is to provide a novel and improved method of counteracting the tendency of stacks of overlapping coherent panels in zig-zag formations to lean in or counter to the direction of advancement of the web or webs which are converted into stacks.

Another object of the invention is to provide a method which renders it possible to automatically counteract the tendency of a web perforating, folding and stacking apparatus to turn out stacks whose configuration departs from an optimum shape.

A further object of the invention is to provide a method which renders it possible to immediately counteract the tendency to form leaning stacks so that the number of leaning stacks is nil or is reduced to a small fraction of those which are turned out in accordance with heretofore known methods.

An additional object of the invention is to provide a novel and improved method of changing the dimensions of selected panels of a web of coherent panels wherein the panels are attached to each other by transversely extending weakened portions of the web.

Still another object of the invention is to provide a method which ensures that the number of rejects, on the ground that certain stacks are unduly deformed, is greatly reduced or that such rejects are eliminated.

A further object of the invention is to provide an apparatus for the practice of the above outlined method and to provide the apparatus with novel and improved means for manually or automatically initiating the undertaking of corrective measures in response to detection of forwardly or rearwardly leaning stacks of superimposed panels in zig-zag formations.

An additional object of the invention is to provide the apparatus with novel and improved means for regulating the speed of the web and with novel and improved means for controlling the path of movement of the web toward and past the weakening station.

Another object of the invention is to provide a production line for the making and processing of webs of paper or the like which embodies the above outlined apparatus.

An additional object of the invention is to provide the apparatus with novel and improved means for selectively changing the dimensions of panels which are connected to each other by transversely extending weakened portions of the web.

A further object of the invention is to provide the apparatus with novel and improved highly versatile control means for monitoring the configuration of stacks and for automatically initiating the undertaking of corrective measures on detection of leaning and/or otherwise deformed stacks.

SUMMARY OF THE INVENTION

One feature of the present invention resides in the provision of a method of transforming a continuous web (particularly a paper web) into a series of stacks of overlapping panels. The method comprises the steps of advancing the web in a predetermined direction along a predetermined path, weakening spaced-apart transversely extending portions of the web in a first portion of the path to thus convert the web into a succession of coherent panels with transversely extending weakened portions between neighboring panels, subjecting the web to a predetermined tensional stress in the first portion of the path, gathering the panels into a series of stacks (with the panels in zig-zag formations) in a second portion of the path downstream of the first portion, monitoring the stacks for deviations from upright positions, and altering the tensional stress upon the web in the first portion of the path on detection of non-upright (leaning) stacks.

The weakening step can include making rows of perforations in the spaced-apart transversely extending portions of the web.

The altering step can include altering the tensional stress during weakening of each m times n-th transversely extending portion of the web (wherein m=2 and n is a whole number including one).

In accordance with a presently preferred embodiment, the altering step includes increasing the tensional stress above the predetermined tensional stress and thereupon reducing the tensional stress upon the web in the first portion of the path. The increasing step preferably includes increasing the tensional stress at a controlled (predetermined) rate.

As a rule, the altering step includes exerting upon the web a pull during weakening of selected transversely extending portions of the web so that selected portions are stretched during weakening of the web. The exerting step can include applying to the web a pull counter to the predetermined direction upstream of the first portion of the path and simultaneously applying to the web a pull in the predetermined direction downstream of the first portion of the path.

The advancing step can include pulling the web downstream of the first portion of the path at a predetermined speed, and the altering step can include changing such speed. Alternatively, or in addition to changing the speed of advancement of the web, the altering step can include changing the length of a third portion of the path upstream of the first portion.

Another feature of the invention resides in the provision of an apparatus for transforming a continuous web, particularly a paper web, into a series of stacks of overlapping panels. The apparatus comprises means for advancing the web in a predetermined direction along a predetermined path, means for weakening spaced-apart transversely extending portions of the web in a first portion of the path to thus convert the web into a succession of coherent panels with transversely extending weakened portions between neighboring panels, means for subjecting the web to a predetermined tensional stress in the first portion of the path, means for gathering the panels into a series of substantially upright stacks (with the panels of the stacks in zig-zag formations) in a second portion of the path wherein some of the stacks tend to assume non-upright positions (i.e., they tend to lean), and means for altering the tensional stress upon the web in the first portion of the path to thus counteract the tendency of stacks to assume non-upright or leaning positions.

The weakening means can include means for providing the spaced-apart transversely extending portions of the web with rows of perforations.

The altering means can include means for periodically altering the tensional stress upon the web in the first portion of the path, and the advancing means can include means for pulling the web in the predetermined direction downstream of the first portion of the path. Such advancing means can further comprise means for moving the web in the predetermined direction upstream of the first portion of the path, and the altering means can include a power train between the pulling means and the moving means. The power train can comprise a differential. The differential is preferably adjustable, and the apparatus then further comprises means for adjusting the differential to thereby alter the tensional stress upon the web by way of one of the moving and pulling means, e.g., by way of the pulling means. The adjusting means can include means for periodically adjusting the differential.

Alternatively, the apparatus can comprise a prime mover for the pulling means, and such prime mover can constitute or form part of the means for altering the tensional stress upon the web.

If the prime mover is designed to drive the moving means upstream of the weakening means, the altering means can comprise a power train (which can include the aforementioned differential) between the prime mover for the moving means and the pulling means, or a power train between the moving means and the pulling means. The just discussed power train can be provided between the moving means and the differential for the pulling means.

The apparatus can comprise a first prime mover (such as a variable-speed electric motor) for the pulling means, and a second prime mover (e.g., the main prime mover of the machine or production line which embodies the improved apparatus) for driving the pulling means at a basic speed by way of the first prime mover. The first prime mover can form part of the means for altering the tensional stress upon the web, and such altering means further comprises means (such as a control unit) for chaning the speed of the first prime mover to thereby vary the tensional stress upon the web.

Instead of or in addition to means for changing the speed of the web by way of the pulling means, the altering means can comprise a web deflector or analogous means for changing the length of the path for the web. The deflector can comprise an idler roller or another suitable rotary element which is movable substantially transversely of a portion of the path for the web, and means for displacing the rotary element. Alternatively, the deflector can comprise a rotary eccentric and means for rotating the eccentric. The deflector is preferably installed upstream of the web weakening means.

The apparatus further comprises means for opposing or resisting changes of tensional stress by the altering means. Such opposing or resisting means can form part of the means for advancing the web along its path.

The web weakening means normally comprises means for cyclically weakening the web in the first portion of the path at a predetermined frequency, and the altering means can include means for increasing the tensional stress upon the web at a predetermined fraction of such frequency, e.g., in response to the making of each first, third, fifth, etc. or each second, fourth, sixth, etc. weakened portion. The means for increasing the tensional stress upon the web in the just outlined manner can include control means (e.g., a computer) having means for generating first signals in response to weakening of the web by the web weakening means, means for generating second signals on detection of non-upright stacks, and means for converting at least some of the first signals and the second signals into third signals. Such means for altering the tensional stress upon the web further comprises means for stretching the web in response to the third signals.

The means for generating second signals can include manually actuatable signal generator means.

Alternatively, or in addition to the provision of manually actuatable signal generator means, the means for generating second signals can include means for monitoring the inclination of stacks in the gathering means. Such monitoring means can include optoelectronic monitoring means.

The signal converting means can include means for converting each m times n-th first signal into a third signal (m=2 and n is a whole multiple of one). Such converting means can include a step-down transmission between the web weakening means and the control means.

The means for generating second signals can include means for generating such signals in dependency upon the direction of of (forward or rearward) inclination of stacks in the gathering means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
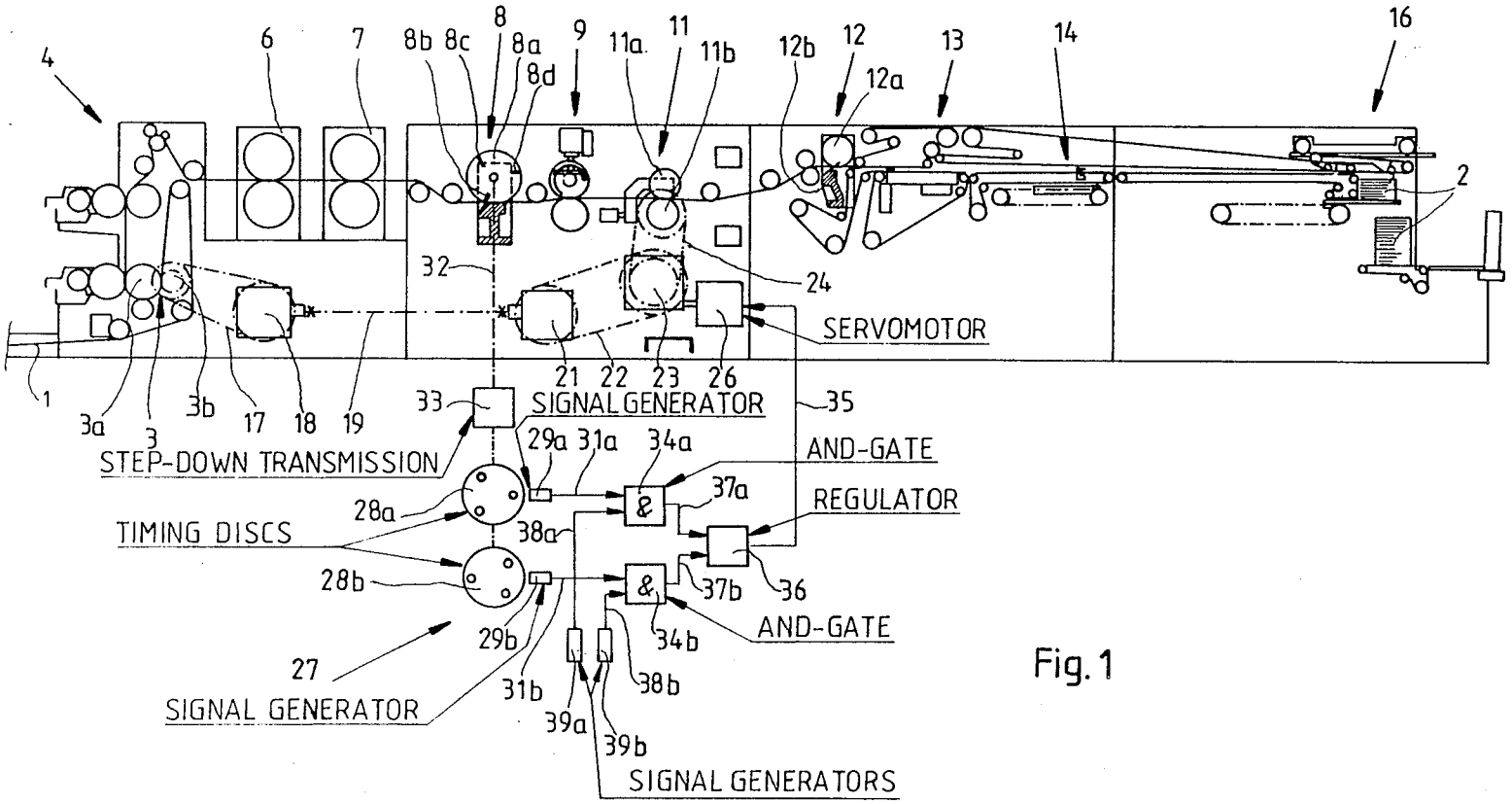
FIG. 1 is a schematic partly elevational and partly longitudinal vertical sectional view of an apparatus which embodies one form of the invention and is designed to make stacks of computer paper or the like, the control means of the apparatus being designed to initiate periodic stretching of the running web in response to manually generated signals upon visual observation of the inclination of growing stacks.

FIG. 1 shows an apparatus for converting a continuous web 1 of paper or the like into a series of discrete piles or stacks 2 wherein coherent panels of the web are folded over each other in zig-zag formations. The improved apparatus can be used with particular advantage for the making of stacks of so-called computer paper wherein coherent panels of each stack are joined by transversely extending weakened portions which are normally formed by providing the web with rows of perforations.

The web 1 is drawn off a bobbin (not shown) or another suitable source and advances in the direction of arrow 42 (FIGS. 2, 3) along a predetermined path extending through a series of successive stations to be converted first into a series of coherent panels la (FIGS. 2 and 3) with transversely extending weakened portions lb between neighboring panels la, and thereupon into shorter web sections preparatory to transformation of successive web sections into discrete stacks 2.

The means for advancing or transporting the web 1 in the direction of arrow 42 along the predetermined path includes a first pulling or moving unit 3 (hereinafter called moving unit) and a second pulling or moving unit 11 (hereinafter called pulling unit). On their way from the unit 3 toward the unit 11, successive increments of the web 1 advance first through an imprinting mechanism 4 of any known design, thereupon through a first perforating device 6 which provides rows of perforations in both marginal portions of the web (such perforations are customary in computer paper), thereafter through a second perforating device 7 which provides longitudinally spaced-apart portions of the web 1 with additional perforations (also customary in computer paper) for manipulation of panels la in and/or upon removal from a computer, and ultimately through a web weakening (third perforating) device 8 which provides the web with the aforementioned transversely extending weakened portions lb between neighboring panels la. The web 1 is folded along the weakened portions lb in a stacking or gathering unit 16 to be thus converted into a series of stacks 2.

A longitudinal cutter 9 can be installed between the web weakening device 8 and the pulling unit 11 to subdivide the web 1 into two or more elongated strips. The cutter 9 is necessary if the width of the web 1 is a multiple of the width of panels of computer paper. Each strip is thereupon treated individually to be converted into a series of stacks 2 wherein the panels are superimposed upon each other in zig-zag formations.

The pulling unit 11 of the means for advancing or transporting the web 1 is operatively connected with the moving unit 3 by a power train in a manner and for the purposes to be described hereinafter.

The pulling unit 11 is followed by a cross cutter 12 which subdivides the web 1 into a series of discrete sections each containing a predetermined number of coherent panels la, namely a number which is required to build a complete stack 2. The cross cutter 12 includes a rotary drum-shaped knife carrier **12*a* at one side of the respective portion of the path of movement of the web 1, and a stationary counterknife 12*b* at the other side of the path opposite the carrier 12*a*. Reference may be had to U.S. Pats. Nos. 4,201,102 and 4,255,998 to Rudszinat which describe suitable cross cutters. The knife or knives on the carrier 12*a* of the cross cutter 12 sever the web 1 along selected weakened portions 1*b***.

The cross cutter 12 is followed by a loop forming unit 13 which operates in a manner as fully described in U.S. Pat. No. 4,708,332. The unit 13 is followed by a staggering or spacing-apart unit 14 which temporarily decelerates the foremost loops of successive sections of the web 1 (such sections are formed by the cross cutter 12) in order to increase the distance between the trailing end of a preceding web section and the leader of the next-following web section. This is described in detail in the copending patent application Ser. No. 268,472 of Peter et al. The folding of neighboring panels **1*a* in each web section is completed in the stacking unit 16 which converts each web section into a discrete stack 2 having a desired number of superimposed panels 1*a* in zig-zag formations. The weakened portions 1*b* (these weakened portions constitute the fold lines of the respective web sections) of a stack 2 form two groups or sets, one at the front or leading side 2*b* and the other at the rear or trailing side 2*a* of the respective stack (see FIGS. 2 and 3), as seen in the direction (arrow 42) of advancement of the web 1** and of its successively formed sections through the improved apparatus.

Figure 2:
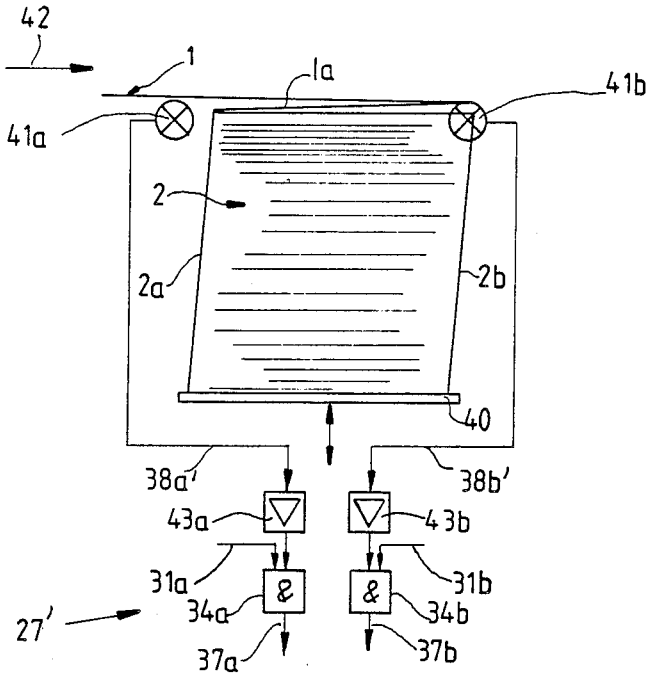
FIG. 2 illustrates a portion of a modified apparatus with control means for automatically initiating the stretching of selected portions of a running web in response to optical detection of forwardly sloping or leaning webs.
Figure 3:
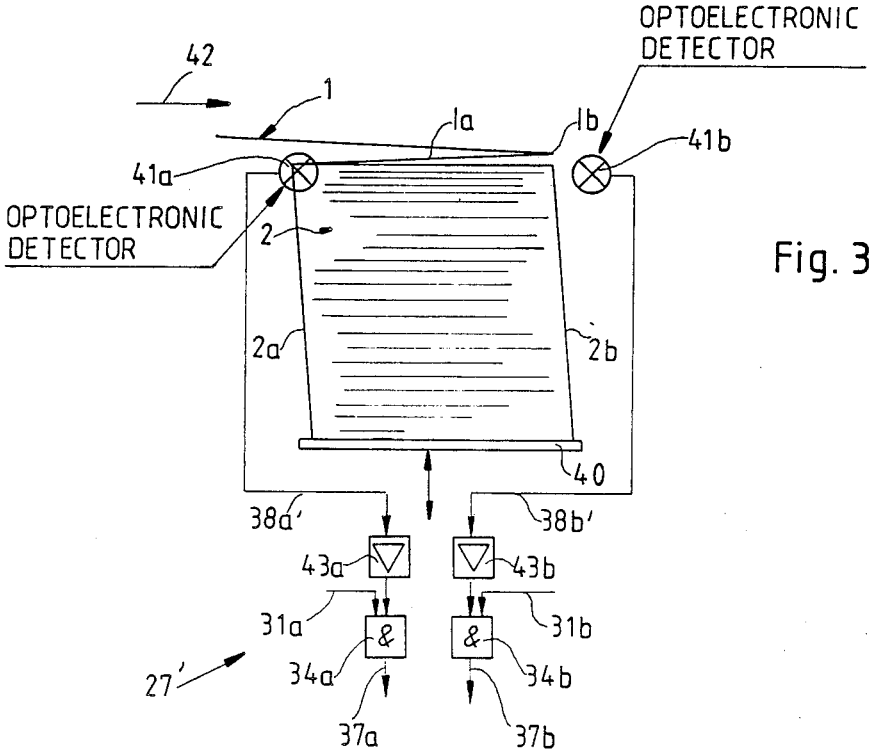
FIG. 3 shows the structure of FIG. 2 but with a stack which leans counter to the direction of advancement of the web.

It has been found that, when a web of paper or the like is converted into a series of stacks 2 in an apparatus of the type described in U.S. Pat. No. 4,708,332, in copending patent application Ser. No. 268,472 or in other known apparatus, certain stacks exhibit a more or less pronounced tendency to lean, particularly in or counter to the direction of movement of the web and its sections. This can be seen in FIG. 2 (wherein the stack 2 leans forwardly, namely in the direction of arrow 42) and in FIG. 3 (wherein the stack 2 leans rearwardly, i.e., counter to the direction of arrow 42). In other words the two groups or sets of fold lines or weakened portions lb at the front and rear sides 2*b*, 2*a* of a growing or fully grown stack 2 are not disposed in two vertical planes so that the shape of a forwardly or rearwardly leaning or sloping stack deviates from a desirable or optimum shape (a parallelepiped wherein all neighboring sides are disposed at right angles to each other). The inclination of stacks 2 which are shown in FIGS. 2 and 3 is exaggerated for the sake of clarity.

A drawback of a stack 2 which leans forwardly or backwards is that it is likely to overturn but especially that it is likely to resist predictable introduction into a prefabricated cardboard box or another receptacle and/or that it cannot be readily confined in an envelope of wrapping paper or the like. Irrespective of the exact nature of problems which arise when a stack 2 leans forwardly or backwards, it is desirable and advantageous to ensure that the apparatus produce upright stacks as well as that the tendency of the apparatus to build forwardly or rearwardly leaning stacks be counteracted as soon as possible, either manually or (and preferably) automatically, so that the number of unsatisfactory (leaning) stacks will be reduced to zero or to a minute fraction of the total number of produced stacks.

It has been discovered that the tendency of stacks 2 to lean in or counter to the direction of arrow 42 can be counteracted in a novel, simple and effective way by periodically changing the existing tensional stress upon selected longitudinally spaced-apart portions of the running web 1 in that portion of the path where the web advances past the web weakening device 8, i.e., in a path portion between the moving unit 3 and the pulling unit 11 of the web advancing or transporting means. The arrangement is preferably such that the tensional stress upon the web portion in the region of the web weakening device 8 is temporarily increased (preferably in an accurately controlled manner) for the making of a row of perforations in the web (i.e., to form the respective weakened portion 1*b*), and that the tensional stress is thereupon reduced, e.g., back to the standard or predetermined tensional stress which is normally applied by the units 3 and 11. The temporary increase of tensional stress results in a stretching of the web portion which is in the process of being provided with a row of perforations. Relaxation of tensional stress upon completion of the perforating step enables the stretched portion of the web 1 to shrink, i.e., the stretch disappears. Otherwise stated, the just discussed stretching and subsequent contraction result in the making of a panel la which is slightly shorter than a standard panel. The difference between the length of a standard panel la and a non-standard panel which has been formed as a result of temporary stretching of the web 1 during making of a row of perforations at the forward or rear end of the non-standard panel is hardly detectable, even by resorting to a highly accurate measuring device. Nevertheless, such difference between standard panels and non-standard panels suffices to overcome the tendency of successively formed stacks 2 to lean forwardly or backwards.

The manner in which the tensional stress upon the running web 1 is varied in the apparatus of FIG. 1 for the purpose of overcoming the aforediscussed tendency of webs 2 to lean in or counter to the direction of arrow 42 is as follows:

As already mentioned hereinbefore, the moving unit 3 is operatively connected with the pulling unit 11 by a power train. The moving unit 3 includes two advancing rolls 3*a*, 3*b* at opposite sides of the respective portion of the path for the web 1 (i.e., upstream of the web weakening device 8), and the pulling unit 11 comprises two advancing rolls 11*a*, 11*b* at opposite sides of the corresponding portion of the path (downstream of the web weakening device 8). The shaft for the advancing roll 3*b* carries a toothed pulley for an endless toothed belt 17 which drives the input element of a first bevel gear transmission 18. The output element of the transmission 18 drives the input element of a second bevel gear transmission 21 through the medium of a cardan shaft 19 having ends connected to the output element of transmission 18 and to the input element of transmission 21 by universal joints. The output element of the second bevel gear transmission 21 drives the input element of an adjustable differential 23 by way of an endless toothed belt 22, and the output element of the differential 23 drives the advancing roll 11*b* of the web pulling unit 11 through the medium of a further toothed belt 24. The means for adjusting the differential 23 (and for thus adjusting the speed of the web 1 in the nip of the advancing rolls 11*a*, 11*b*) includes a servomotor 26 which can receive signals from a control unit 27 by way of a conductor 35. It will be seen that the advancing roll 3*b* of the moving unit 3 drives the advancing roll 11*b* of the pulling unit 11 so that the units 3, 11 cooperate to normally subject the web portion between the nip of the rolls 3*a*, 3*b* and the nip of the rolls 11*a*, 11*b* to a predetermined standard or initial tensional stress. The stress upon the web portion which is adjacent the web weakening device 8 can be increased or reduced by changing the speed of the advancing roll 11*b*, i.e., by adjusting the differential 23 in response to signals from the control unit 27 by way of the servomotor 26. The aforementioned standard or initial tensional stress upon the web portion between the units 3, 11 of the means for advancing or transporting the web 1 along its predetermined path can be selected to match an optimum value by appropriate selection of the diameters of advancing rolls 3*a*, 3*b* and 11*a*, 11*b* and/or the RPM of such advancing rolls. The standard tensional stress is maintained as long as the unit 16 continues to build satisfactory (upright) stacks 2. At such time, the servomotor 26 is idle because the conductor 35 does not transmit any signals which would initiate an acceleration or deceleration of the advancing roll 11*b*.

When an operator or an element of the control unit 27 detects that the unit 16 is in the process of building a forwardly or rearwardly leaning stack 2, the conductor 35 is caused to transmit one or more signals which induce the servomotor 26 to accelerate the advancing roll 11*b* through the medium of the adjustable differential 23 (either once or more than once) in order to induce the unit 16 to build upright stacks 2. As mentioned above, each controlled acceleration of the advancing roll 11*b* (i.e., each controlled increase of tensional stress upon the web portion in the region of the web weakening device 8) is followed by a reduction of tensional stress so that the previously stretched web portion is free to contract and to cause a slight or minute shortening of the respective panel or panels 1*a*.

The control unit 27 comprises two rotary timing discs 28*a*, 28*b* which are driven by the cyclically operated web weakening device 8 through the medium of a step-down transmission 33. The timing discs 28a, 28b respectively cooperate with signal generators 29a, 29b (each of which can constitute a proximity switch) to transmit signals to the corresponding inputs and two AND-gates 34a, 34b. The output 31a of the signal generator 29a transmits signals denoting the making of alternating oddly numbered weakened portions 1b, and the output 31b of the signal generator 29b transmits signals denoting the making of alternating evenly numbered weakened portions 1b (or vice versa). The illustrated web weakening device 8 comprises a drum-shaped carrier 8a for three circumferentially spaced apart equidistant perforating combs 8b, 8c, 8d having sets of prongs or needles with each set capable of making a row of perforations, i.e., a weakened web portion 1b. The aforementioned step-down transmission 33 is installed in the operative connection or power train 32 (indicated schematically by a phantom line) between the shaft for the carrier 8a of the web weakening device 8 and the timing discs 28a, 28b. The transmission 33 has a step-down ratio of 1:2, i.e., each of the discs 28a, 28b cooperates with the respective signal generator 29a, 29b to generate signals at half the frequency of making weakened portions 1b with the combs 8b–8d of the carrier 8a forming part of the web weakening device 8. In addition, the magnets or other suitable signal generation initiating elements on the timing disc 28a are staggered relative to the signal generation initiating elements of the timing disc 28b so as to ensure that signals which are transmitted by the output 31a of the signal generator 29a alternate with signals which are transmitted by the output of the signal generator 29b. Thus, and as mentioned above, signals from the output 31a of the signal generator 29a to the corresponding input of the AND-gate 34a denote the making of alternating oddly numbered weakened portions 1b (e.g., those disposed along the rear side 2a of a growing stack 16), and signals from the output 31b of the signal generator 29a to the corresponding input of the AND-gate 34b denote the making of alternating evenly numbered weakened portions 1b (e.g., those disposed at the front side 2b of a growing stack 16).

The outputs 37a, 37b of the AND-gates 34a, 34b are connected with the corresponding inputs of a regulator 36 which is connected with the servomotor 26 by way of the aforementioned conductor 35. The regulator 36 is designed to transmit signals via conductor 35 to initiate a stretching of the web in the region of the web weakening device 8 when it receives a signal from the output 37a or 37b. The output 37a can transmit a signal when the AND-gate 34a receives a signal from the signal generator 29a simultaneously with a signal from a signal generator 39a. Analogously, the output 37b can transmit a signal when the AND-gate 34b receives a signal from the signal generator 29b simultaneously with a signal from a signal generator 39b. The reference characters 38a and 38b respectively denote the outputs of the signal generators 39a, 39b or the second inputs of the corresponding AND-gates 34a, 34b. The signal generators 39a, 39b are caused to transmit signals via outputs 38a, 38b in response to detection of a tendency of the stack 2 in the unit 16 to lean backwards (timing disc 28a and AND-gate 34a) or forwardly (timing disc 28b and AND-gate 34b).

The signal generators 39a, 39b can be actuated manually by an operator who observes the building of stacks 2 in the unit 16, or by automatic monitoring means, e.g., optoelectronic monitoring means of the type shown in FIGS. 2 and 3. The control unit 27 of FIG. 1 is designed for manual actuation of the signal generators 39a, 39b. On the other hand, the modified control unit 27' of FIGS. 2 and 3 is provided with optoelectronic monitoring means including a pair of sensors 41a, 41b and means for transmitting signals from the outputs 38a', 38b' of the respective sensors to the corresponding inputs of the AND-gates 34a, 34b.

The sensor 41a monitors the rear side 2a of a stack 2 in the unit 16, and the sensor 41b monitors the front side 2b of such stack. Each of these sensors comprises a radiation source which is designed to transmit at least one beam of radiation transversely of the direction which is indicated by the arrow 42, and an optoelectronic transducer which is installed in the path of the respective beam or beams and is provided with the corresponding output 38a', 38a' for the transmission of signals to the respective gate 34a, 34b by way of a signal amplifier 43a, 43b.

The stack 2 which is in the process of growing in the unit 16 is supported by a platform 40 which descends at the rate at which the unit 16 receives panels 1a from the preceding unit 14, and the sensors 41a, 41b are preferably installed at a level slightly below the topmost panel or panels 1a on the descending platform 40. The means for lowering the platform 40 (e.g., in stepwise fashion) is not shown in FIGS. 2 and 3.

In FIG. 2, wherein the stack 2 leans forwardly, the foremost portion or portions of one or more topmost panels la of the stack 2 on the platform 40 interrupt the beam or beams of radiation from the source to the transducer of the sensor 41b to thus indicate that the stack 2 leans forwardly (in the direction of arrow 42). The output 38b' of the transducer forming part of the sensor 41b transmits signals to the amplifier 43b which transmits amplified signals to the corresponding input of the AND-gate 34b. When the other input of the gate 34b receives a signal from the output 31b of the signal generator 29b (not shown in FIG. 2), the output 37b of the gate 34b transmits a signal to the regulator 36 (see FIG. 1) which transmits a signal via conductor 35 so that the servomotor 26 adjusts the differential 23 (and hence the speed of the advancing rolls 11a, 11b) during the making of a first selected series of weakened portions 1b.

FIG. 3 shows that the stack 2 on the platform 40 leans rearwardly, i.e., the transducer of the sensor 41a transmits signals via output 38a' and amplifier 43a to the corresponding input of the AND-gate 34a. When the other input of the gate 34a receives a signal from the output 31a of the associated signal generator 29a (FIG. 1), the output 37a of the gate 34a transmits a signal to the regulator 36 which causes the servomotor 26 to adjust the differential 23 so that the speed of the advancing rolls 11a, 11b is temporarily increased in order to stretch the web adjacent the web weakening device 8 during the making of a second selected series of weakened portions 1b. The amplifiers 43a, 43b constitute an optional but desirable feature of the control unit 27'. In all other respects (i.e., save for the provision of amplifiers 43a, 43b and save for substitution of optoelectronic monitoring means 41a, 41b for the manually actuatable signal generators 39a, 39b), the control unit 27' is or can be identical with the control unit 27.

The step-down transmission 33 can be modified in a number of ways without departing from the spirit of the invention. For example, this transmission can be designed to change the step-down ratio between the carrier 8a of the web weakening device 8 and the timing discs 28a, 28b to a while multiple of the aforementioned 1:2 ratio, i.e., to a ratio of 1:4, 1:6, etc. This ensures that the differential 23 will accelerate the advancing rolls 11a, 11b only for the making of each first, fifth, ninth, etc. weakened portion 1b (if the ratio is 1:4) or that the differential 23 will accelerate the advancing rolls 11a, 11b only for the making of each second, sixth, tenth, etc. weakened portion (it being again assumed that the selected ratio of the transmission 33 is 1:4), depending upon whether the signals for periodic stretching of the web 1 between the units 3 and 11 are generated at 29a (41a) or 29b (41b). Analogously, the differential 23 will accelerate the rolls 11a, 11b for the making of each first, seventh, thirteenth, etc. weakened portion 1b (signals from 29a or 41a) or for the making of each second, eighth, fourteenth, etc. weakened portion 1b (signals from 29b or 41b) if the selected step-down ratio of the transmission 33 is 1:6. In this manner, the operator can ensure that the number of weakened portions 1b which are formed while the respective portion of the web 1 is stretched beyond the standard stretch (standard or predetermined tensional stress) only as often as is absolutely necessary to reverse the trend toward the building of forwardly or rearwardly sloping or leaning stacks 2. Otherwise stated, the transmission 33 will be adjusted to initiate an increase of tensional stress upon the web 1 in the region of the web weakening device 8 at a frequency which is a function of detected inclination of the stack 2 on the platform 40 of the stacking unit 16. For example, the single sensor 41a and/or 41b can be replaced by a battery of sensors each of which can transmit signals to the respective amplifier 43a or 43b as well as to a motor which automatically changes the step-down ratio of the transmission 33, depending upon detected inclination of the side 2a or 2b of the stack 2 on the platform 40.

Figure 4:
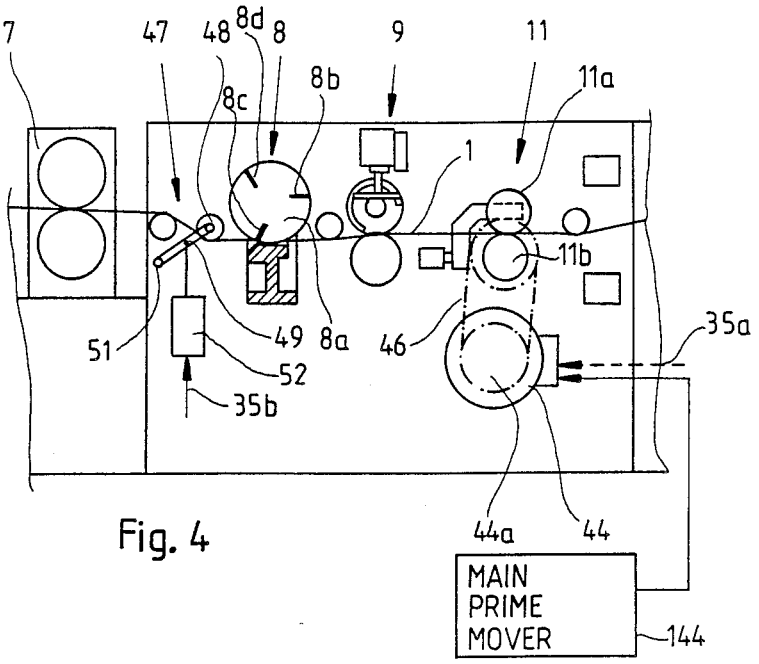
FIG. 4 is fragmentary partly elevational and partly longitudinal vertical sectional view of an apparatus wherein the web can be stretched by a deflector.

The operative connection between the units 3 and 11 of the means for advancing or transporting the web 1 along its path can be omitted or deactivated if the apparatus comprises a discrete prime mover 44 (FIG. 4) for the advancing rolls 11a, 11b of the pulling unit 11. A toothed pulley or gear 44a on the output shaft of the prime mover 44 (e.g., a variable-speed electric motor) drives the advancing roll 11b by way of a toothed belt 46. In order to synchronize the speed of the advancing rolls 11a, 11b with that of the advancing rolls 3a, 3b (not shown in FIG. 4), the pulling unit 11 can be connected with the moving unit 3 by means of a so-called electronic shaft. An electronic shaft of the type capable of being put to use in the apparatus of FIG. 4 is disclosed, for example, in U.S. Pat. No. 4,683,704 to Vorachek et al.

The apparatus of FIG. 4 can be modified by installing a differential between the prime mover 44 and the advancing roll 11b and by using a servomotor (corresponding to the servomotor 26 of FIG. 1) to adjust the differential in response to signals from the control unit 27 or 27' in order to change the tensional stress upon the web 1. However, and as shown in FIG. 4, it is equally possible to establish a direct connection between the control unit 27 or 27' and the adjustable prime mover 44 (note the conductor 35a corresponding to the conductor 35 shown in FIG. 1) so that the control unit 27 or 27' can regulate the speed of the prime mover 44 for the purpose of increasing or relaxing the tensional stress upon selected portions of the web 1 during weakening of such selected portions by the web weakening device 8. The prime mover 44 can receive motion from a main prime mover 144 to drive the advancing rolls 11a, 11b at a basic speed (to thus ensure that the web portion between the units 3 and 11) is subjected to a predetermined standard tensional stress) when the unit 16 is in the process of building acceptable (upright) stacks 2. A signal which is transmitted via conductor 35a initiates an acceleration of the pulley 44a so that the basic speed (induced by the main prime mover 144) is replaced by a higher speed which suffices to ensure adequate stretching of one or more selected web portions during the making of oddly or evenly numbered weakened portions 1b, depending upon whether the stack leans forwardly or backwards.

The main prime mover 144 can drive all or at least the majority of moving parts of the apparatus including the advancing roll 3a or 3b, the perforating devices 6, 7, the imprinting mechanism 4, the web weakening device 8, the cutters 9 and 12, the platform 40 of the stacking or gathering unit 16 and others.

Figure 5:
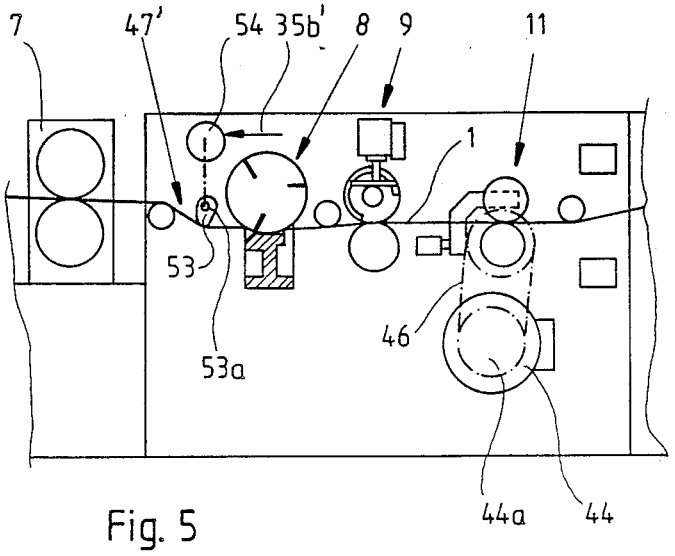
FIG. 5 illustrates the structure of FIG. 4 but showing a modified deflector for the web.

The heretofore described embodiments of the improved apparatus are designed to operate on the principle that the tensional stress upon the web 1 is increased by increasing the speed of the web 1 in the region of the web weakening device 8 in response to an acceleration of advancing rolls 11a, 11b with reference to the advancing rolls 3a, 3b, i.e., in response to exertion of a more pronounced pull upon the web 1 (by the unit 11) downstream of the web weakening device 8. However, it is equally possible to increase the tensional stress upon the web by varying the length of the path for the web ahead or upstream of the web weakening device 8. Two such embodiments of the improved apparatus are shown in FIGS. 4 and 5. The embodiment of FIG. 4 employs a path changing means or deflector 47, and the embodiment of FIG. 5 employs a modified deflector 47'. Each of these deflectors is adjacent the path of movement of the web 1 upstream of the web weakening device 8, e.g., between the devices 7 and 8. Each of the deflectors 47, 47' can receive signals from a control unit 27 or 27', i.e., the control unit can initiate a change in the length of the path for the web 1 ahead of the web weakening device 8 whenever an operator or an automatic monitoring means detects the building of forwardly or rearwardly leaning stacks 2 on the platform 40 of the stacking unit 16.

The deflector 47 of FIG. 4 comprises a rotary roller-shaped path changing element 48 which is mounted at the free end of a lever 49 for movement substantially transversely of a portion of the path for the web 1. The lever 49 is pivotably mounted on a fixed shaft 51 which is installed in the frame of the apparatus embodying the structure of FIG. 4. A displacing device in the form of a fluid-operated (e.g., pneumatic) cylinder and piston unit 52 is provided to pivot the lever 49 in response to signals from the control unit 27 or 27' (neither of these control units is actually shown in FIG. 4) by way of a conductor 35b corresponding to the conductor 35 of FIG. 1. If the tensional stress upon the web 1 in the region of the web weakening device 8 is to be increased, the conductor 35b transmits a signal which causes the cylinder and piston unit 52 to pivot the lever 49 in a clockwise direction in order to lengthen the path for the web 1 ahead of the path portion wherein the web is provided with transversely extending weakened portions 1b. The tensional stress is relaxed when the making of a row of perforations by one of the combs 8b–8d on the rotary carrier 8a of the web weakening device 8 is completed so that the web portion which has been formed with a row of perforations is free to contract, i.e., that the corresponding panel 1*a* of the web is somewhat shorter than the other panels.

While it is conceivable to use the conductor 35*a* jointly with the conductor 35*b*, i.e., to use the control unit 27 or 27' for transmission of signals to the prime mover 44 as well as to the unit 52, one of the two illustrated means for changing the tensional stress upon the web 1 can be omitted or deactivated. This is indicated in FIG. 4 in that the conductor 35*a* leading from the control unit 27 or 27' to the variable-speed prime mover 44 is shown by broken lines.

The deflector 47' in the apparatus of FIG. 5 comprises an eccentric 53 which can change the length of the path for the web 1 ahead or upstream of the web weakening device 8 in response to rotation about the axis of its shaft 53*a*. The latter can be turned by a servomotor 54 which is a functional equivalent of the servomotor 26 and receives signals from the control unit 27 or 27' via conductor 35*b'*.

The prime mover 44 of FIG. 5 is optional if the tensional stress upon the web 1 is influenced by the eccentric 53.

The control unit 27 can be modified to comprise optoelectronic or other suitable detector means, which monitors the inclination of a growing stack 2, in addition to the manually operated signal generators 39*a*, 39*b*. Analogously, the control unit 27' can be modified by adding the manually actuatable signal generators 39*a*, 39*b* or other suitable means for generating signals as a result of visual detection of a forwardly or rearwardly sloping or leaning stack 2.

It is clear that, in each embodiment of the improved apparatus, lengthening of the path for the web 1 upstream of the web weakening device 8 and/or acceleration of the web downstream of the device 8 for the purpose of increasing the tensional stress upon one or more selected portions of the web necessitates the provision of some means for resisting or opposing an acceleration of the web upstream of the device 8 or a change of the path for the web upstream and downstream of the deflector 47 or 47'. In the illustrated embodiments, the means for resisting or opposing acceleration of the web 1 and/or a lengthening of the path for the web includes the moving unit 3. However, such function can also be performed by other units or devices of the improved apparatus, e.g., by the perforating device 6 and/or 7. All that counts is to ensure that the web is force- and/or form-lockingly engaged in a manner to enable the advancing rolls 11*a*, 11*b* of the pulling unit 11 and/or the deflector 47 or 47' to stretch the web in the region of the device 8 against a certain opposition which is needed to ensure that the web is actually stretched for the purpose of making one or more rows of perforations in the stretched portion or portions of the web.

Certain details of the control units 27, 27' are shown in FIGS. 1 to 5 for the purpose of facilitating the understanding of my invention. However, and especially if the improved apparatus is built into an automated production line which turns out large numbers of stacks 2 per unit of time, the operations which were described as being carried out by the control unit 27 or 27' are preferably carried out by a suitable computer.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for transforming a continuous web, particularly a paper web, into a series of stacks of overlapping panels, comprising means for advancing the web in a predetermined direction along a predetermined path; means for weakening spaced-apart transversely extending portions of the web in a first portion of said path to thus convert the web into a succession of coherent panels with transversely extending weakened portions between neighboring panels, including means for cyclically weakening the web in said first portion of said path at a predetermined frequency; means for subjecting the web to a predetermined tensional stress in the first portion of said path; means for gathering the panels into a series of substantially upright stacks, with the panels of the stacks in zig-zag formations, in a second portion of said path wherein some of the stacks tend to assume non-upright positions; and means for altering the tensional stress upon the web in the first portion of said path to thus counteract the tendency of stacks to assume non-upright positions, said altering means including means for increasing the tensional stress upon the web at a predetermined fraction of said frequency and said means for increasing the tensional stress including control means having means for generating first signals in response to weakening of the web by said weakening means, means for generating second signals on detection of non-upright stacks, and means for converting at least some of said first and second signals into third signals, said altering means further comprising means for stretching the web in response to said third signals.

2. The apparatus of claim 1, wherein said weakening means includes means for providing the spaced-apart transversely extending portions of the web with rows of perforations.

3. The apparatus of claim 1, wherein said altering means includes means for periodically altering the tensional stress upon the web in the first portion of said path.

4. The apparatus of claim 1, wherein said advancing means includes means for pulling the web in said direction downstream of the first portion of said path.

5. The apparatus of claim 4, wherein said advancing means further comprises means for moving the web in said direction uPstream of the first portion of said path, said altering means including a power train between said pulling means and said moving means.

6. The apparatus of claim 5, wherein said power train comprises a differential.

7. The apparatus of claim 6, wherein said differential is adjustable and further comprising means for adjusting said differential to thereby alter the tensional stress upon the web by way of one of said moving and said pulling means.

8. The apparatus of claim 7, wherein said adjusting means includes means for periodically adjusting said differential.

9. The apparatus of claim 4, further comprising a prime mover for said pulling means.

10. The apparatus of claim 9, wherein said altering means includes said prime mover.

11. The apparatus of claim 4, wherein said advancing means further comprises means for moving the web in said direction upstream of the first portion of said path and a prime mover for said moving means, said altering means including a power train between said moving means and said pulling means.

12. The apparatus of claim 4, wherein said advancing means further comprises means for moving the web in said direction upstream of the first portion of said path, said altering means including a differential arranged to drive said pulling means and a power train between said moving means and said differential.

13. The apparatus of claim 4, further comprising a first prime mover for said pulling means and a second prime mover for driving said pulling means at a basic speed by way of said first prime mover.

14. The apparatus of claim 13, wherein said first prime mover includes a variable-speed motor and forms part of said altering means, said altering means further comprising means for changing the speed of said motor to thereby vary the tensional stress upon the web.

15. The apparatus of claim 1, wherein said altering means includes means for changing the length of said path.

16. The apparatus of claim 15, wherein said changing means includes a rotary element which is movable substantially transversely of a portion of said path.

17. The apparatus of claim 16, wherein said changing means further comprises means for displacing said rotary element.

18. The apparatus of claim 15, wherein said changing means comprises a rotary eccentric.

19. The apparatus of claim 18, wherein said changing means further comprises means for rotating said eccentric.

20. The apparatus of claim 15, wherein said changing means is located upstream of said web weakening means.

21. The apparatus of claim 1, further comprising means for opposing changes of tensional stress by said altering means 22. The apparatus of claim 21, wherein said opposing means includes a portion of said advancing means.

23. The apparatus of claim 1, wherein said means for generating second signals includes manually actuatable signal generator means.

24. The apparatus of claim 1, wherein said means for generating second signals includes means for monitoring the inclination of stacks in said gathering means.

25. The apparatus of claim 24, wherein said monitoring means includes optoelectronic monitoring means.

26. The apparatus of cIaim 1, wherein said signal converting means includes means for converting each m times n-th first signal into a third signal wherein $m=2$ and n is a whole number including one.

27. The apparatus of claim 1, wherein said converting means includes a step-down transmission between said web weakening means and said control means.

28. The apparatus of claim 1, wherein said means for generating second signals includes means for generating second signals in dependency on the direction of inclination of stacks in said gathering means.

* * * * *